US007950614B1

(12) United States Patent
Strobridge

(10) Patent No.: US 7,950,614 B1
(45) Date of Patent: May 31, 2011

(54) MEDICAL EQUIPMENT OVERHEAD MOUNTING STRUCTURE

(76) Inventor: Stephen A. Strobridge, Perinton, NY (US)

( * ) Notice: Subject to any disclaimer, the term of this patent is extended or adjusted under 35 U.S.C. 154(b) by 0 days.

(21) Appl. No.: 11/111,596

(22) Filed: Apr. 22, 2005

(51) Int. Cl.
*A47H 1/10* (2006.01)
*G09F 7/18* (2006.01)

(52) U.S. Cl. ..... 248/317; 248/342; 248/343; 248/344; 52/39

(58) Field of Classification Search ..... 248/317, 248/342–344; 52/22, 27, 39
See application file for complete search history.

(56) References Cited

U.S. PATENT DOCUMENTS 1,570,496 A * 1/1926 Jones ..... 248/317
2,865,634 A * 12/1958 Townsend ..... 473/482
3,066,757 A * 12/1962 Robinson et. al. ..... 182/36
3,563,539 A * 2/1971 Rogers et al. ..... 482/37
3,577,947 A * 5/1971 Draeseke ..... 114/61.2
3,931,452 A * 1/1976 Nilsson ..... 174/491
3,982,360 A * 9/1976 Newman ..... 52/22
3,999,338 A * 12/1976 Behan, Jr. et al. ..... 52/90.1
4,041,657 A * 8/1977 Schuplin ..... 52/39
4,081,931 A * 4/1978 Miyoshi ..... 52/39
4,135,692 A * 1/1979 Ferguson ..... 248/544
4,243,147 A * 1/1981 Twitchell et al. ..... 212/284
4,644,595 A * 2/1987 Daniel ..... 5/83.1
5,098,055 A * 3/1992 Leonian ..... 248/317
5,314,156 A * 5/1994 Moses ..... 248/317
5,456,655 A * 10/1995 Morris ..... 601/23
5,618,017 A * 4/1997 De Boer ..... 248/201
6,089,518 A * 7/2000 Nilsson ..... 248/317
6,488,097 B1 * 12/2002 MacDonald et al. ..... 169/43
6,637,710 B2 * 10/2003 Yaphe et al. ..... 248/317
2004/0159761 A1 * 8/2004 Lipsky ..... 248/323

* cited by examiner

*Primary Examiner* — Terrell Mckinnon
*Assistant Examiner* — Michael McDuffie
(74) *Attorney, Agent, or Firm* — Stephen B. Salai, Esq.; Michael J. Didas, Esq.; Harter Secrest & Emery LLP

(57) ABSTRACT

A system for removable installation and nondestructive removal and reinstallation of a stationary mast from which to suspend equipment on articulated arms for point-of-need positioning thereof includes parallel headers extending in a first horizontal direction, each with fasteners adjustably movable along its top for releasable connection to building structure over the headers, for selective emplacement of the headers relative to the building structure. Cross members extending under the headers are releasably fastened to the headers for emplacement, stationary but variable, along the headers. A mast depends from the cross members to support articulated arms and medical equipments.

9 Claims, 2 Drawing Sheets

NOTES:

1. DIMENSION VARIES BY APPLICATION.
2. MAST (40) CAN BE POSITIONED ANYWHERE BETWEEN ITEMS (10).

NOTES:

1. DIMENSION VARIES BY APPLICATION.
2. MAST (40) CAN BE POSITIONED ANYWHERE BETWEEN ITEMS (10).

NOTES:

1. DIMENSION VARIES BY APPLICATION.
2. MAST CAN BE POSITIONED ANYWHERE BETWEEN ITEMS (10)
3. DEPENDENT UPON MAST (40) LENGTH TO ALLOW FOR PROPER ANGLE "X" OF ITMES (50) .

MEDICAL EQUIPMENT OVERHEAD MOUNTING STRUCTURE

BACKGROUND OF THE INVENTION

This invention relates to a standardized and repeatable system for attaching articulating arm suspended equipment to an overhead building structure. More particularly, the invention relates to a pre-engineered and pre-manufactured rigidly designed mast structure attached to a pre-engineered and pre-manufactured releasably designed support carriage allowing for a repeatable, proven, easily installed, non-fixed method to bridge the distance between said equipment mounting flange located at finished ceiling elevation to the overhead building structure.

Articulating arm suspended equipment is highly dependent on the rigidity of the mounting structure in order to eliminate drifting. The equipment is typically mounted in an operating, emergency, critical care, wet lab area or the like, to an overhead mounting structure attached to the overhead building structure. The mounting structure is typically custom designed, fabricated and installed to meet a specific project site and application. Said mounting structure is typically custom designed to be field fit, fabricated and permanently welded or affixed to the existing overhead building structure making it difficult and time consuming to build and position the mounting structure. The fixed and field fabricated nature of the overhead mounting structure increases the complexity and difficulty of installation and limits the ease of future room layout changes and equipment rearrangements.

An object of this invention is to provide a pre-engineered, pre-fabricated, relocatable and repeatable system and method for attaching said articulated arm suspended equipment to an overhead building structure. The invention includes a frame that is removably bolted to the existing building structure, and easily adjustable and positionable in the X and Y directions relative to the floor below. A mast and system of bracing is moveably attached to the frame to allow for mounting of the articulating arm suspended equipment at the proper elevation above the finished floor. All components are designed to strict deflection criteria to eliminate drifting of the articulated arm suspended equipment.

Prior art includes U.S. Pat. Appl. No. 2004/0159761 A1 (Lipsky). Lipsky is not relevant to this invention but only to certain structures included in it, as will become clear.

SUMMARY OF THE INVENTION

In summary, this invention is a system for removable installation and nondestructive removal and reinstallation of a stationary mast from which to suspend equipment on articulated arms for point-of-need positioning thereof. The system includes parallel headers extending in a first horizontal direction, each with fasteners adjustably movable along its top for releasable connection to building structure over the headers, for selective emplacement of the headers relative to the building structure. Cross members extending under the headers are releasably fastened to the headers for emplacement, stationary but variable, along the headers. A mast depends from the cross members to support articulated arms and medical equipments.

DRAWINGS

DESCRIPTION

In the elevation view of FIG. 1, a building structure includes parallel beams 10; a finished ceiling 11 suspended below the building beams 10, and a floor 12 below the ceiling 11. The room space or working space between floor 12 and ceiling 11 includes, for example, a surgical table, overhead equipment mounted on articulated arms, including surgical equipment, surgical lights, flat panel monitors, etc. The mounting structure is removably mounted to the underside of building beams 10, in the space between the beams 10 and the suspended ceiling 11, out of sight from the room below.

Figure 1:
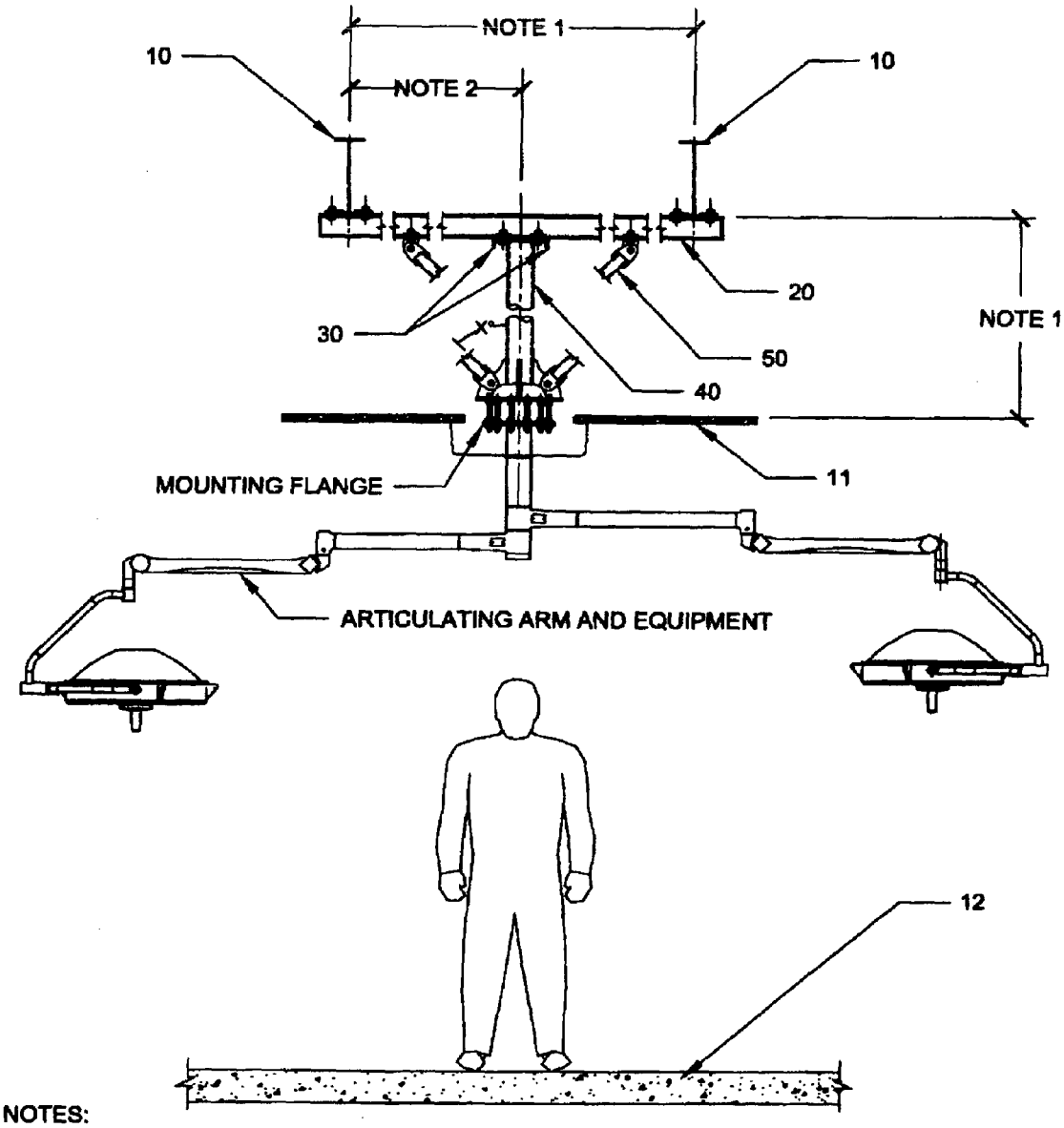
FIG. 1 is an elevation view of an overhead mounting structure according to the system of this invention.
Figure 2:
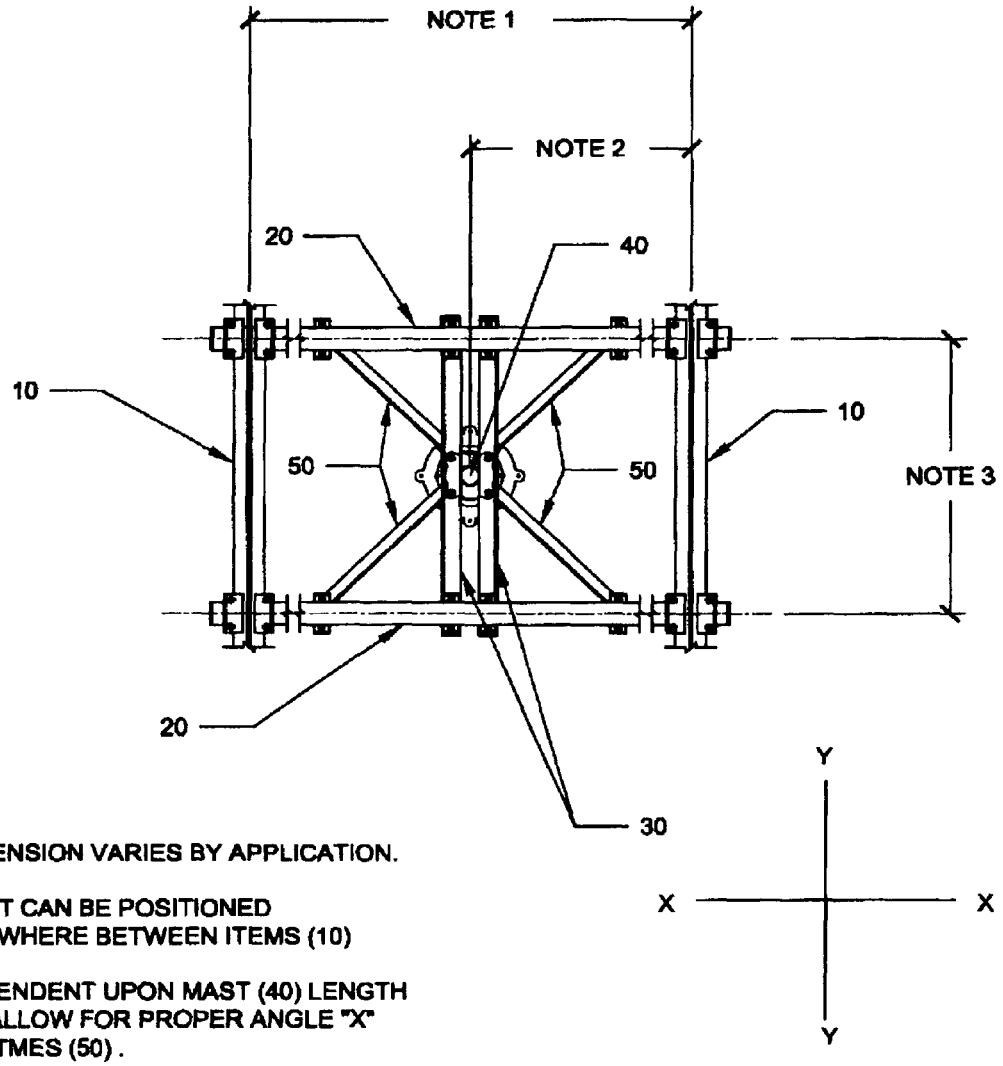
FIG. 2 is a top view of the mounting structure of FIG. 1.

Referring now to FIGS. 1 and 2, a mounting structure according to this invention includes parallel headers 20, cross members 30, a vertical mast 40, and sway braces 50.

Headers 20 are parallel horizontal members extending horizontally, under and crosswise of two successive building beams 10, and releasably secured to the building beams 10 by suitable fasteners. The headers 20 are of length and size determined primarily by the distance between them and by the distance between building beams 10. Releasable fasteners facilitate the removal and reemplacement of headers 20 relative to the building beams 10.

Cross members 30 extend under and crosswise of the headers 20, and are releasably secured to the headers 20 for removal and reemplacement along headers 20, as desired.

The mast 40 is bolted or otherwise secured to the cross members 30, depending vertically from them to support various items of mounted equipment. The vertical height of the mast 40 is determined by the available space between the headers 20 and the suspended ceiling 11.

Sway braces 50, releasably connected to the mast 40 and to the headers 20, distribute load to the headers 20 and reduce stress concentration on the mast 40. Sway braces 50 may or may not be required, depending on the bending moment on the mast 40, which in turn depends on factors such as mast length and equipment load.

The Lipsky prior art, mentioned above, discloses an overhead instrument support, including X and Y rails forming a trolley system, whereby medical equipment suspended from the system is freely movable, back and forth and side to side, in real time.

The mounting system and structure of the present invention, fixed to building structure, is fixed releasably and removably, for nondestructive repositioning and reemplacement of a mast 40, relative to building structure and to floor below.

The terms "emplacement" and "reemplacement" are used here to connote, indeed to mean and to emphasize, that the desired result of this invention is to install a mast that is stationarily in place (or emplaced), but removable for reemplacement if desired.

The header mounting arrangement of this invention allows for distribution of load forces to the building structure. The arrangement is boltable and variable to allow for quick and consistent installation and to facilitate room reconfiguration, and is therefore preferred where permitted by considerations of equipment placement.

The structure illustrated in FIGS. 1, 2 includes two headers 20. If equipment placements make it necessary, the same two headers can be used to support multiple masts 40 with cross members 30.

FIG. 1 shows surgical lights mounted on the mast 40. The lights are only examples. The mounting system of this invention is intended for use with surgical lights and with other items of medical/surgical equipment as appropriate to the site.

The term "beam" herein includes structural members such as rolled steel shapes, fabricated trusses, joists, and pre-manufactured concrete supports. The term "mounted equipment" means any and all kinds of equipment or other items to be supported by the mast 20. Terms indicative of orientation are used as descriptive words with reference to the drawing, not as limitations. Apparatus described herein retains its described character whether oriented as shown or otherwise. The term "geometry" pertains to configurations and spatial relationships of points, lines, directions, and distances in the described structure.

The system of this invention facilitates routinized construction of overhead mounting structure, unlike the prior art in which such mounting structures are custom designed and built. The system is "routinized", meaning that the structure is pre-engineered and provided for on-site assembly from standard or pre-cut components in the nature of a kit.

The foregoing description of a preferred embodiment is illustrative of the invention. The concept and scope of the invention are limited not by the details of that description but only by the following claims and equivalents thereof.

What is claimed is:

1. A building structure including a floor, overhead beams, a ceiling disposed below said beams, and a system for custom installation and nondestructive removal and reinstallation of a stationary mast from which to suspend equipments on articulated arms for point-of-need positioning of said equipments below said ceiling, said system including:

parallel horizontal headers disposed in a space between said beams and said ceiling and extending in a direction perpendicular to a longitudinal direction of said overhead beams, each of said headers including fasteners adjustably movable along the top thereof for releasable fastening to said overhead beams, said headers thereby adapted for selective stationary emplacement under said beams; and a cross member disposed in said space between said beams and said ceiling, said cross member extending crosswise under said headers and releasably fastened thereto, said cross member thereby configured for selective stationary emplacement along the lengths of said headers;

said mast depending from said cross member, through said ceiling, for supporting connection to said articulated arms and said equipments;

whereby said mast is adapted for stationary emplacement and nondestructive reemplacement in a horizontal plane relative to said building structure.

2. A system as defined in claim 1, further including sway braces releasably and adjustably connected to said mast and to said headers to distribute load on said mast to said headers.

3. A mounting structure selectively mountable to two or more parallel overhead beams, the structure comprising:

two headers spaced from each other and extending generally horizontally, each header being releasably fastened below and to at least two of the parallel overhead beams;

at least one cross member extending between the two headers;

a ceiling disposed below the two headers and the at least one cross member; and a vertical mast affixed to and depending downwardly from the cross member through the ceiling.

4. The mounting structure of claim 3, further comprising releasable fasteners configured to fasten at least one of the headers to the parallel overhead beams and the cross member to the headers.

5. The mounting structure of claim 4, wherein when the releasable fasteners are configured to fasten the headers to the parallel overhead beams, the fasteners are released to allow a user to selectively position the headers in a horizontal plane.

6. The mounting structure of claim 4, wherein when the releasable fasteners are configured to fasten the cross member to the headers, the fasteners are released to allow a user to selectively position the cross member along the headers.

7. The mounting structure of claim 3, further comprising a sway brace extending from one of the headers proximate a distal end of the mast.

8. The mounting structure of claim 3, wherein the headers are configured for perpendicular attachment to the overhead beams.

9. The mounting structure of claim 3, further comprising articulated arms disposed on the distal end of the vertical mast.

* * * * *